US007337485B2

(12) United States Patent
Metzger

(10) Patent No.: US 7,337,485 B2
(45) Date of Patent: Mar. 4, 2008

(54) DOUBLE HIGH AIRBED UTILIZING COILS

(75) Inventor: Andrew T. Metzger, Newnan, GA (US)

(73) Assignee: The Coleman Company, Inc., Wichita, KS (US)

( * ) Notice: Subject to any disclaimer, the term of this patent is extended or adjusted under 35 U.S.C. 154(b) by 235 days.

(21) Appl. No.: 11/218,043

(22) Filed: Aug. 31, 2005

(65) Prior Publication Data

US 2007/0044243 A1 Mar. 1, 2007

(51) Int. Cl.
*A47C 27/08* (2006.01)

(52) U.S. Cl. ..... 5/712; 5/711; 5/682

(58) Field of Classification Search ..... 5/712, 5/711, 710, 706, 682, 683, 684, 655.3
See application file for complete search history.

(56) References Cited

U.S. PATENT DOCUMENTS

| | | | |
|---|---|---|---|
| 1,610,898 | A | 12/1926 | Steiner |
| 2,360,715 | A | 10/1944 | Perry |
| 3,604,027 | A | 9/1971 | Konno |
| 3,608,107 | A | 9/1971 | Kentor et al. |
| 3,705,429 | A | 12/1972 | Nail |
| 3,780,388 | A | 12/1973 | Thomas et al. |
| 3,815,887 | A | 6/1974 | Curtis et al. |
| 4,181,990 | A | 1/1980 | Santo |
| 4,296,510 | A | 10/1981 | Phillips |
| 4,371,999 | A | 2/1983 | Reid |
| 4,541,135 | A | 9/1985 | Karpov |
| 4,547,919 | A | 10/1985 | Wang |
| 4,644,597 | A | 2/1987 | Walker |
| 4,782,542 | A | 11/1988 | Sato |
| 4,823,417 | A | 4/1989 | Fukuichi |
| 4,858,263 | A | 8/1989 | Echevarria et al. |
| 4,895,352 | A | 1/1990 | Stumpf |
| 5,002,336 | A | 3/1991 | Feher |
| 5,022,109 | A | 6/1991 | Pekar |
| 5,105,488 | A | 4/1992 | Hutchinson et al. |
| 5,452,487 | A | 9/1995 | Leggett |
| 5,524,307 | A | 6/1996 | Griffin |
| 5,598,593 | A | 2/1997 | Wolfe |
| 5,608,931 | A | 3/1997 | Gancy |
| 5,729,840 | A | 3/1998 | Wu |
| 5,740,573 | A | 4/1998 | Boyd |
| 5,746,873 | A | 5/1998 | Graf |
| 5,852,839 | A | 12/1998 | Gancy |
| 5,906,019 | A | 5/1999 | McCarthy et al. |
| 5,927,696 | A | 7/1999 | Hagemeister |
| 5,960,495 | A | 10/1999 | Hsu et al. |
| 6,073,291 | A | 6/2000 | Davis |
| 6,161,231 | A | 12/2000 | Kraft et al. |
| 6,568,011 | B2 | 5/2003 | Fisher et al. |
| 6,625,830 | B2 | 9/2003 | Lampel |
| 6,643,875 | B2 | 11/2003 | Boso et al. |
| 6,701,559 | B2 | 3/2004 | Boso et al. |
| 6,971,134 | B2 | 12/2005 | Wu |
| 2003/0188388 | A1 | 10/2003 | Boso et al. |

FOREIGN PATENT DOCUMENTS

| | | |
|---|---|---|
| WO | WO 90/07891 | 7/1990 |

*Primary Examiner*—Alexander Grosz
(74) *Attorney, Agent, or Firm*—Leydig, Voit & Mayer, Ltd.

(57) ABSTRACT

A double high airbed having a central layer, upper coils extending from the central layer to a top sheet of the airbed, and lower coils extending from the central layer to the bottom sheet of the airbed. The central layer is formed of an upper middle layer and a lower middle layer. These two middle layers are welded together and extend the length and width of the airbed.

6 Claims, 2 Drawing Sheets

26
40
3
38
22
50
3
30
24
54
32
20
28
50

40
26
38
38
38
34
32
44
50
44
36
52
42
28
42

DOUBLE HIGH AIRBED UTILIZING COILS

TECHNICAL FIELD OF THE INVENTION

The present invention is directed to airbeds, and more specifically to reinforcing structures for airbeds.

BACKGROUND OF THE INVENTION

An airbed is a large rectangular rubber or plastic bag that is filled with air so that it may be used as a bed. Airbeds are well known in the art and have proven themselves to be very useful. On the one hand, when there is no need to sleep on an inflatable airbed, an owner may simply deflate the airbed (i.e., let all the air out), fold the airbed, and then store the airbed away in a closet or basement. On the other hand, when guests arrive or when the owner of the airbed takes a trip to a place where there is no bed, the owner may simply inflate the airbed and sleep on it.

Most conventional inflatable airbeds have a single chamber, meaning that air can travel anywhere inside the airbed because there is no barrier sealing off one portion of the airbed from another. Therefore, when multiple people sleep or sit on the airbed, air is constantly moved from one portion of the airbed to another as the weight of the person is shifted.

For example, suppose person A is sleeping on the left side of an inflated queen size airbed. Because there is currently no weight on the right side of the airbed, air would naturally flow toward the unweighted right side of the airbed until an equilibrium pressure condition is established (i.e., the right side cannot hold anymore air). This shifting of air to the right side consequently would cause the right side of the airbed to rise.

Next, suppose person B wants to sleep on the now elevated right side of the airbed. As person B descends onto the right side of the airbed, this new weight causes a redistribution of the air back toward the left side of the airbed where person A is sleeping. Air flows back to the left side of the air bed, causing the left side to rise due to the newly added air pressure underneath. This unexpected elevation in the left side of the airbed may even awake person A. Furthermore, each time person A or B moves around during their sleep and causes a shift in weight on the airbed, air may also be shifted around inside the entire airbed. This constant movement of air inside the airbed in response to weight shifts causes different portions of the airbed to rise and fall until the weight movement stops. This constant rocking, elevation or depression of various portions of the airbed every time one person moves can disrupt a good night's sleep.

To address the unequal distribution of air in an airbed, a variety of different constructions have been used to control the structure and shape of airbeds. A first type is an internal I-beam structure, having a material that extends from an interior of a top wall of an airbed to an interior of a bottom wall of the airbed. This structure is designed in such a way to consist of well defined start and stop points, the start and stop points attached to the inner surfaces of the airbed. The I-beam prevents portions of the airbed adjacent to the I-beam from rising beyond a certain height. However, I-beams are inherently weak because of the start and stop points.

An improvement to the I-beam construction is the concept of coil designs. Coils allow for an effectively closed loop to be attached at upper and lower portions of the loop to the interior portions of the upper and lower walls of the airbed.

Because a loop is used, there are effectively no start and stop points in this design. Thus, this structure more evenly distributes stress along the inner surfaces of the airbed, and thereby greatly improves the performance and durability of an airbed.

Recently, manufacturers have produced and sold airbeds of greater height or thickness, such that the airbeds more closely resembled a box spring and mattress combination in function and height. This type of an airbed being known as a two layer or a "double high" airbed. Examples of this type of mattress are shown in U.S. Pat. No. 4,547,919 to Wang, U.S. Pat. No. 5,598,593 to Wolfe, and U.S. Pat. No. 6,568,011 to Fisher et al., respectively. As shown in the '011 patent to Fisher et al., the double high airbed is essentially comprised of two stacked single height air mattresses formed with a lower chamber and a separate upper chamber. This is also shown in U.S. Pat. No. 6,073,291 to Davis.

Although this type of double high airbed construction has provided increased comfort levels over single layer or height air mattresses, problems with these known types of mattress construction remain, chief among them being the inability to internally support the mattress so that any internal beams or columns used to form the mattress extend continuously from the bottom face to the top face of the mattress for more uniformly strengthening the mattress, and for more uniformly limiting the expansion or deflection of the mattress faces during use.

SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

The present invention provides an airbed having a double high configuration. In accordance with an embodiment, the airbed includes a central layer, upper coils extending from the central layer to a top sheet of the airbed, and lower coils extending from the central layer to the bottom sheet of the airbed. In an embodiment, the central layer is formed of an upper middle layer and a lower middle layer. These two middle layers are welded together and extend the length and width of the airbed.

In an embodiment, the central layers include openings therethrough for allowing the passage of air. In this manner, a single valve may be used to inflate both the upper and lower chambers of the airbed.

Use of the upper middle layer and the lower middle layer permits a manufacturer to weld coils to each of these middle layers, and then weld the two middle layers together. In this manner, welding does not have to occur on opposite sides of the same plastic sheet, thus providing a more stable structure.

Other features of the invention will become apparent from the following detailed description when taken in conjunction with the drawings, in which:

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Figure 1:
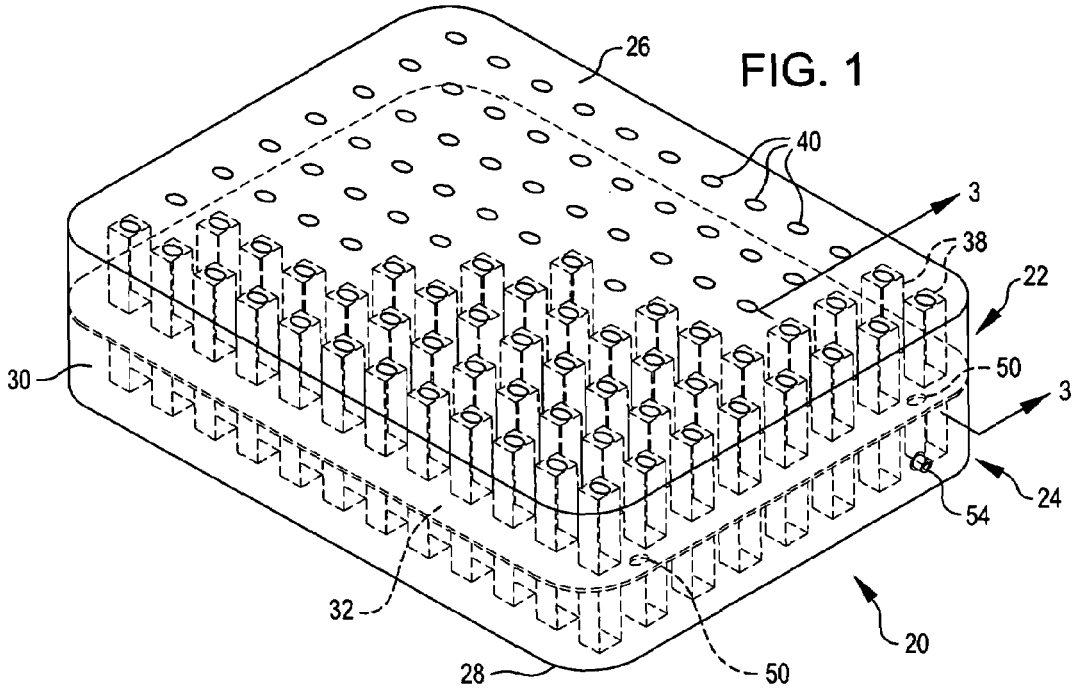
FIG. 1 is side perspective view of an airbed incorporating an embodiment of the invention.

Referring now to the drawings, in which like reference numerals represent like parts throughout the several views, FIG. 1 shows an airbed 20 incorporating an embodiment of the invention. The airbed 20 shown in the drawings includes an upper chamber 22 and a lower chamber 24. The airbed 20 is of a double high configuration, typically ranging from 18 to 24 inches in height. However, aspects of the present invention may be utilized in airbeds having a configuration other than double high, or in a double high airbed having a height outside the range above.

The airbed 20 includes a top sheet 26 and a bottom sheet 28. The side edges of the top sheet 26 and the bottom sheet 28 are welded or otherwise connected to side panels or walls 30 that extend around the perimeter of the airbed 20.

Figure 2:
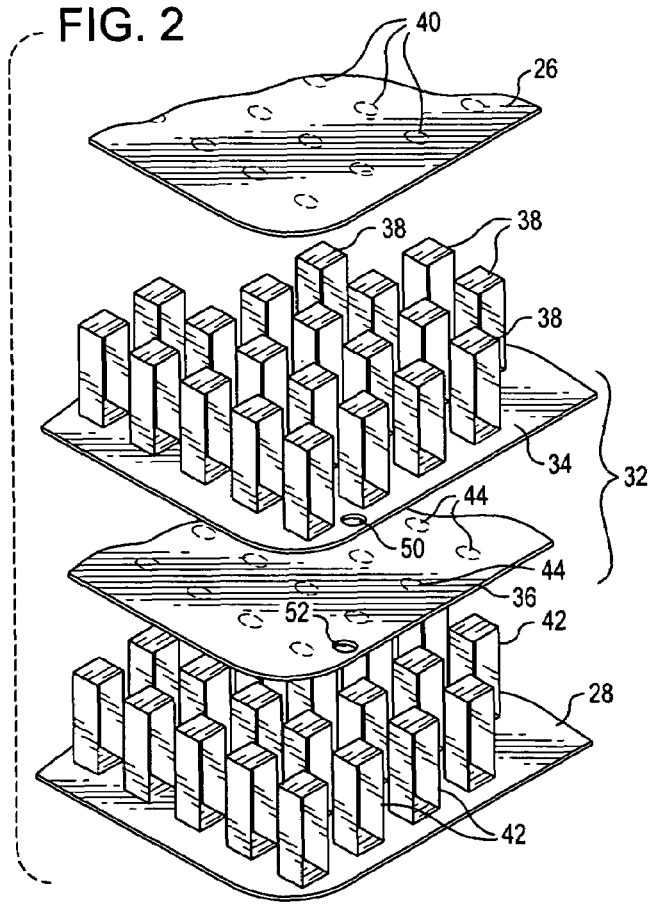
FIG. 2 is an exploded side perspective view of the airbed of FIG. 1.

The airbed 20 includes a central layer 32. In the embodiment shown, the central layer 32 is formed of an upper middle layer 34 and a lower middle layer 36 (best shown in FIG. 2). In an embodiment, the upper middle layer 34 and the lower middle layer 36 are formed of the same material (i.e., have the same material composition) as the top sheet 26 and the bottom sheet 28. The structure of these layers may be different, however; for example, the top layer may include flocking or additional pattern or structure for comfort. Alternatively, a different material may be used for one or more of these layers.

Upper coils 38 extend from the top sheet 26 to the upper middle layer 34. Briefly described, the upper coils 38 are formed of a single piece of material that forms a tube. Alternatively, the upper coils 38 may be formed of more than one piece of material, but in any event are shaped like tubes. An upper portion of the tube is connected to the top sheet 26 and a lower portion of the tube is connected to the upper middle layer 34.

The upper coils 38 are attached to the top sheet 26 and the upper middle layer 34 by oval welds 40. Although oval welds 40 are shown in the drawings, other welds may be used, including any type of ellipse-like weld such as circular, triangular, or rectangular shaped welds, or more narrow welds. In addition, although a single weld is shown for attaching a coil 38 to the top sheet 26 and another, single oval weld 40 is shown as attaching the upper middle layer 34 to the upper coil 38, two or more welds may be used at the attachment of the upper coils 38 to the top sheet 26 and/or the upper middle layer 34.

In the embodiment shown, the upper coils 38 are provided as short segments, and a series of upper coils are provided along the length of the airbed 20. However, in an alternate embodiment, longer coils may be provided, having multiple oval welds, such as the oval welds 40, or similar welds, for attaching the elongate coils to the top sheet 26 and the upper middle layer 34. In another alternate embodiment, upper coils may extend almost the length of the airbed and may be attached by multiple oval welds or similar welds along the length of the coils.

The upper coils 38 are welded, for example via the oval welds 40, to the top sheet 26 and the upper middle layer 34. When in place, the upper coils 38 provide structure for the airbed 20, more particularly the upper chamber 22 of the airbed 20, as can be seen in FIG. 1. The upper coils 38 prevent relative movement of the top sheet 26 in the area adjacent to the upper coils.

Lower coils 42 are attached to the bottom sheet 28 and the lower middle layer 36 in a manner similar to the connection of the upper coils 38 to the top sheet 26 and the upper middle layer 34. As an example, the lower coils 42 may be connected by oval welds 44. Other connection methods may be used, and the connection of the lower coils 42 to the bottom sheet 28 and/or the lower middle layer 36 may be different than the connection of the upper coils 38 to the top sheet 26 and/or the upper middle layer 34.

In an embodiment, the top sheet 26, the bottom sheet 28, the side walls 30, the central layer 32, the upper coils 38, and the lower coils 42 are all formed from the same material (i.e., have the same material composition). In an embodiment, the material is polyvinylchloride (PVC). However, other suitable materials may be used. PVC, however, is typically used for airbeds, and provides quick, easy, and secure welding between components of the airbed 20.

Figure 3:
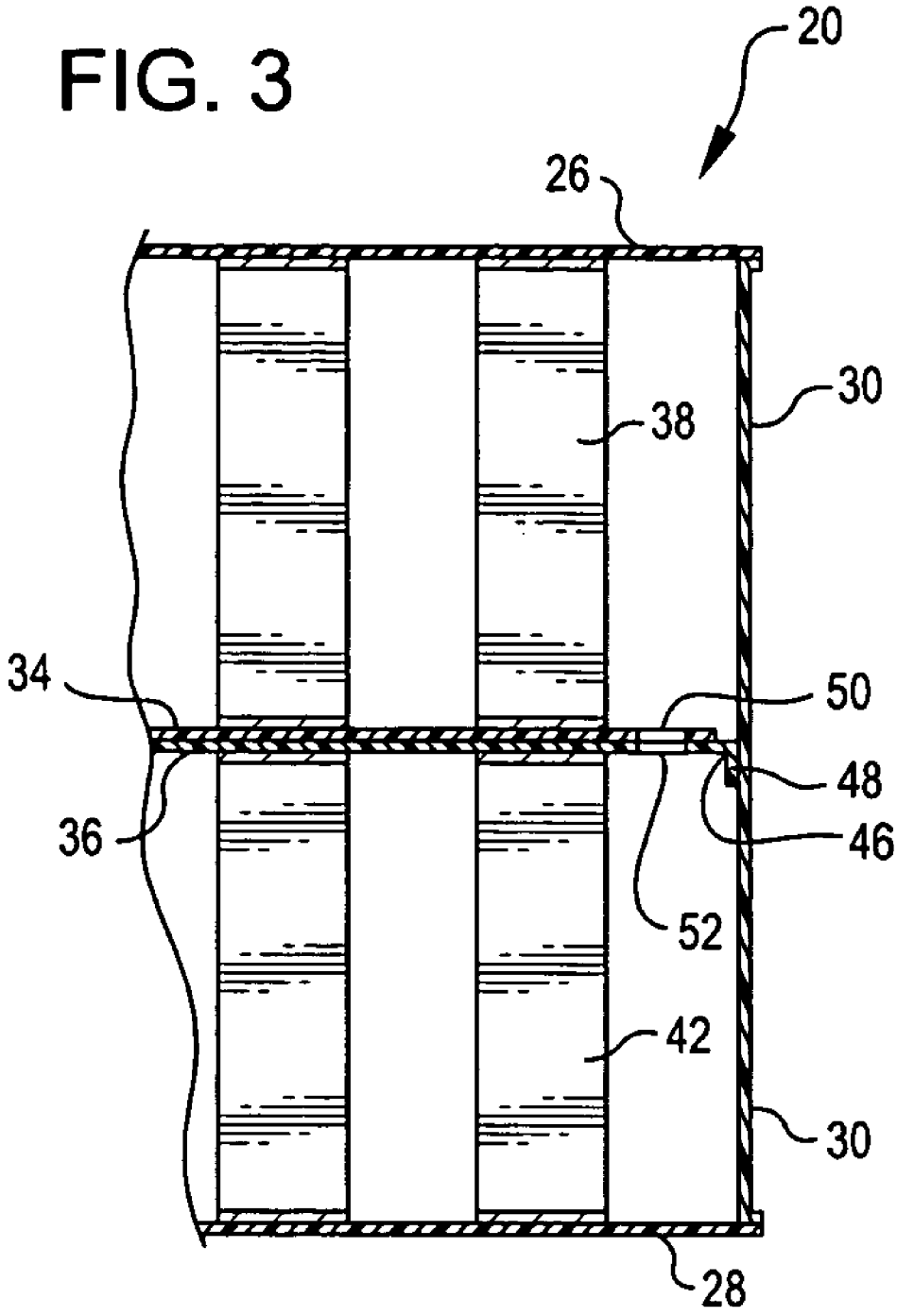
FIG. 3 is a sectional view taken along section lines 3-3 of FIG. 1.

In an embodiment, one of the upper middle layer 34 and the lower middle layer 36 is wider and longer than the other. This feature is shown in FIG. 3, where the lower middle layer 36 is longer than the upper middle layer 34. This feature allows an extension 46 to be formed in the lower middle layer 36. This extension may be folded to form a bend 48. The bend 48 may then be welded to an inner portion of the side walls 30. By welding the central layer 32 to the side walls 30, outward flexing of the side walls 30 when the airbed 20 is inflated is minimized. Although described of having one of the upper middle layer 34 and the lower middle layer 36 bent to provide a welding point (i.e., the bend 48), only particular sections of one or both of the upper middle layer 34 and the lower middle layer 36 may be welded to the side walls 30, or both of the upper middle layer and the lower middle layer may be attached to the side walls.

In an embodiment, the extension 46 extends around the entire central layer 32 so that the side walls 30 may be attached around the entire perimeter. However, the extension may extend around only a portion of the perimeter, or may be attached around less than the entire perimeter, such as a weld every two inches.

In the embodiment shown, openings 50, 52 extend through the upper middle layer 34 and the lower middle layer 36. These openings 50, 52 provide fluid communication between the upper chamber 22 and the lower chamber 24. In the embodiment shown, the openings 50, 52 are located at ends of the upper middle layer 34 and lower middle layer 36, more specifically at the head and foot ends of the airbed 20, but the openings 50, 52 may be located in another position on the central layer 34. Of course, if the extension 46 does not extend around the entire perimeter, air would be free to flow around the central layer, and the openings would not be needed.

A valve 54 is provided for inflating the airbed. The openings 50, 52 permit the single valve 54 to be utilized for inflating both the upper chamber 22 and the lower chamber 24. That is, air may flow into the lower chamber 24 via the valve and flow from the lower chamber to the upper chamber 22 via the openings 50, 52. If desired, in accordance with an alternate embodiment, the chambers 22, 24 may be fully separated, each with its own valve, so that the chambers may be inflated at different pressures, or one of the chambers may not be inflated at all.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An airbed comprising:

a top sheet;

a bottom sheet;

a side panel connected to edges of the top sheet and the bottom sheet, the side panel and the top sheet and bottom sheet forming an enclosure;

a central layer extending horizontally through the enclosure and connected about at least portions of the perimeter of the side panel and dividing the enclosure into two chambers;

at least one opening causing the chambers to be in fluid communication with one another;

upper coils extending from the central layer to a top sheet;

lower coils extending from the central layer to the bottom sheet;

wherein the central layer comprises:

an upper middle layer that is connected to the upper coils; and a lower middle layer that is connected to the lower coils; and wherein one of the upper middle layer and the lower middle layer have edge portions extending beyond edge portions of the other middle layer and this extended edge portion being connected to the side panel.

2. The airbed of claim 1, wherein a connection of the upper coils to the upper middle layer comprises welding.

3. The airbed of claim 2, wherein a connection of the lower coils to the lower middle layer comprises welding.

4. The airbed of claim 3, wherein a connection of the upper middle layer to the lower middle layer comprises welding.

5. The airbed of claim 1, wherein the top sheet, bottom sheet, central layer, side panel, upper coils, and lower coils comprise the same material.

6. The airbed of claim 1, wherein a connection of the upper middle layer to the lower middle layer comprises welding.

* * * * *